US009968182B2

(12) United States Patent
Reichmuth

(10) Patent No.: US 9,968,182 B2
(45) Date of Patent: May 15, 2018

(54) CLEANING DEVICE WITH FLUID DISPENSER

(71) Applicant: Gregory R. Reichmuth, Denver, CO (US)

(72) Inventor: Gregory R. Reichmuth, Denver, CO (US)

( * ) Notice: Subject to any disclaimer, the term of this patent is extended or adjusted under 35 U.S.C. 154(b) by 0 days. days.

(21) Appl. No.: 15/405,153

(22) Filed: Jan. 12, 2017

(65) Prior Publication Data

US 2017/0224097 A1 Aug. 10, 2017

Related U.S. Application Data

(60) Provisional application No. 62/291,404, filed on Feb. 4, 2016.

(51) Int. Cl.

| | |
|---|---|
| ***A47L 13/22*** | (2006.01) |
| ***A46B 9/02*** | (2006.01) |
| ***A46B 5/00*** | (2006.01) |
| ***A47K 11/10*** | (2006.01) |
| ***A46B 11/00*** | (2006.01) |

(52) U.S. Cl.

CPC ..... *A46B 9/026* (2013.01); *A46B 5/0095* (2013.01); *A46B 11/001* (2013.01); *A46B 11/0041* (2013.01); *A47K 11/10* (2013.01)

(58) Field of Classification Search

CPC .... A47K 11/10; A46B 11/002; A46B 11/0041
See application file for complete search history.

(56) References Cited

U.S. PATENT DOCUMENTS

| | | | | |
|---|---|---|---|---|
| 6,364,557 | B1 * | 4/2002 | Dougherty | A46B 11/0041 401/183 |
| 6,623,201 | B2 * | 9/2003 | Brumlik | A46B 11/0013 401/270 |
| 6,848,852 | B2 * | 2/2005 | Engert | A47K 11/10 15/246 |
| 6,851,881 | B2 * | 2/2005 | Slaboden | A46B 11/0041 401/201 |
| 9,622,629 | B1 * | 4/2017 | Brittain | A47K 11/10 |
| 2005/0074275 | A1 * | 4/2005 | Hart | A46B 11/0003 401/279 |
| 2005/0158116 | A1 * | 7/2005 | Belansky | A46B 11/001 401/270 |
| 2005/0232688 | A1 * | 10/2005 | Gavira Montes | A46B 7/04 401/289 |
| 2007/0237570 | A1 * | 10/2007 | Lim | A46B 11/0017 401/279 |

* cited by examiner

*Primary Examiner* — Jennifer C Chiang

(57) ABSTRACT

A cleaning device with fluid dispenser is a device that is used to clean a surface. The device includes an elongated hollow handle with an internal cavity for holding cleaning fluid. A cap is removably engaged to an open end of the elongated hollow handle while a one-way valve plate is positioned within the open end. A cleaning implement is slidably engaged through the cap and is positioned adjacent to an expandable slot of the one-way valve plate. The expandable slot is opened when the cleaning implement is pressed against the expandable slot, enabling cleaning fluid within the elongated hollow handle to exit through the expandable slot and into the cleaning implement. The cleaning implement includes a plurality of bristles that may be saturated by the cleaning fluid after the fluid exits the elongated hollow handle.

11 Claims, 8 Drawing Sheets

DETAIL A

DETAIL C

SECTION D-D

CLEANING DEVICE WITH FLUID DISPENSER

The current application claims a priority to the U.S. Provisional Patent application Ser. No. 62/291,404 filed on Feb. 4, 2016.

FIELD OF THE INVENTION

The present invention relates generally to a cleaning apparatus. More specifically, the present invention is a cleaning device with fluid dispenser that is used to clean various types of surfaces.

BACKGROUND OF THE INVENTION

Spots and stains are common in both residential and commercial settings. These spots and stains are unsightly and can ruin the decor of an environment. The spots and stains may be difficult to remove from surfaces once dried. Additionally, certain types of stains such as ink, coffee, and grease may be particularly difficult to remove. As a result, it is common to apply a cleaning solution to the spots and stains before attempting removal. This can be very time-consuming or uncomfortable, particularly if one must get down on hands and knees in order to apply cleaning solution to a surface before cleaning. Applying cleaning solution can also be inconvenient as cleaning solution is typically independent of cleaning tools.

The present invention is a cleaning device with fluid dispenser that may be used to clean a variety of surfaces. The present invention allows cleaning fluid to be dispensed directly from the cleaning device in order to eliminate the need to separately apply cleaning solution to a spot or stain before cleaning. The present invention includes a cleaning head that may be removed and replaced. As a result, the present invention may be utilized in conjunction with a wide range of cleaning heads such as cleaning brushes and cleaning pads. The present invention may thus be utilized to clean various types of surfaces such as toilet bowls and hard floors.

DETAIL DESCRIPTIONS OF THE INVENTION

Figure 1:
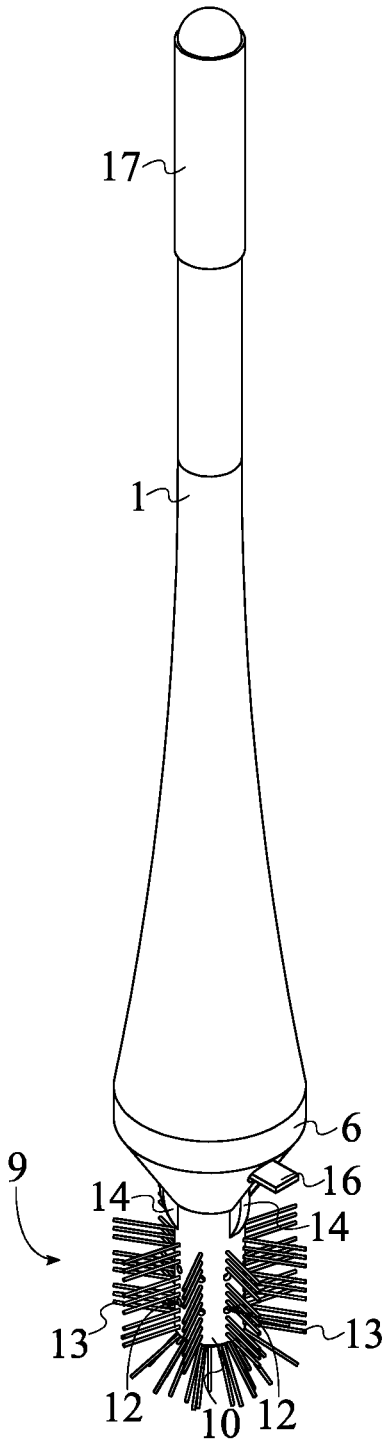
FIG. 1 is a perspective view of the present invention.

All illustrations of the drawings are for the purpose of describing selected versions of the present invention and are not intended to limit the scope of the present invention.

The present invention is a cleaning device with fluid dispenser that is used to clean various types of surfaces. The present invention is shown in FIGS. 1-8 and comprises an elongated hollow handle 1, a one-way valve plate 4, a cap 6, and a cleaning implement 9.

With reference to FIGS. 1-4, the elongated hollow handle 1 serves as a receptacle for cleaning fluid that is dispensed from the cleaning implement 9 when the present invention is in use. The elongated hollow handle 1 is also grasped by the user when the present invention is in use. The elongated hollow handle 1 comprises an open end 2 through which cleaning fluid may be poured into the cavity within the elongated hollow handle 1. The one-way valve plate 4 enables cleaning fluid within the elongated hollow handle 1 to be dispensed into the cleaning implement 9 while preventing cleaning fluid from exiting the elongated hollow handle 1 when the present invention is not in use. The one-way valve plate 4 comprises an expandable slot 5 through which cleaning fluid is able to pass. The one-way valve plate 4 is hermetically positioned within the open end 2, forming a seal and preventing cleaning fluid within the elongated hollow handle 1 from leaking when the present invention is not in use.

The cap 6 holds the one-way valve plate 4 in place within the open end 2 to prevent leakage of cleaning fluid within the elongated hollow handle 1. The cap 6 is removably and hermetically engaged to the open end 2, allowing the one-way valve plate 4 to seal the open end 2 and prevent leakage of cleaning fluid. The cap 6 is additionally positioned around the open end 2 in order to follow enclose the one-way valve plate 4 within the open end 2. The one-way valve is positioned within the cap 6, enabling cleaning fluid to exit from the elongated hollow handle 1 through the one-way valve without leaking.

Figure 5:
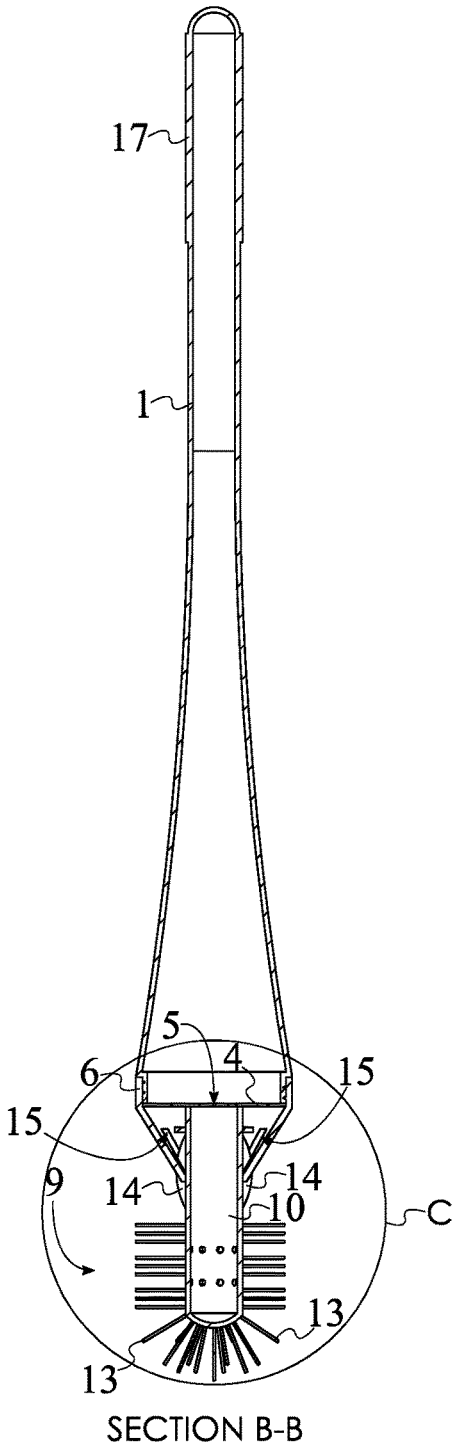
FIG. 5 is a cross-sectional view of the present invention taken along line B-B of FIG. 4.
Figure 6:
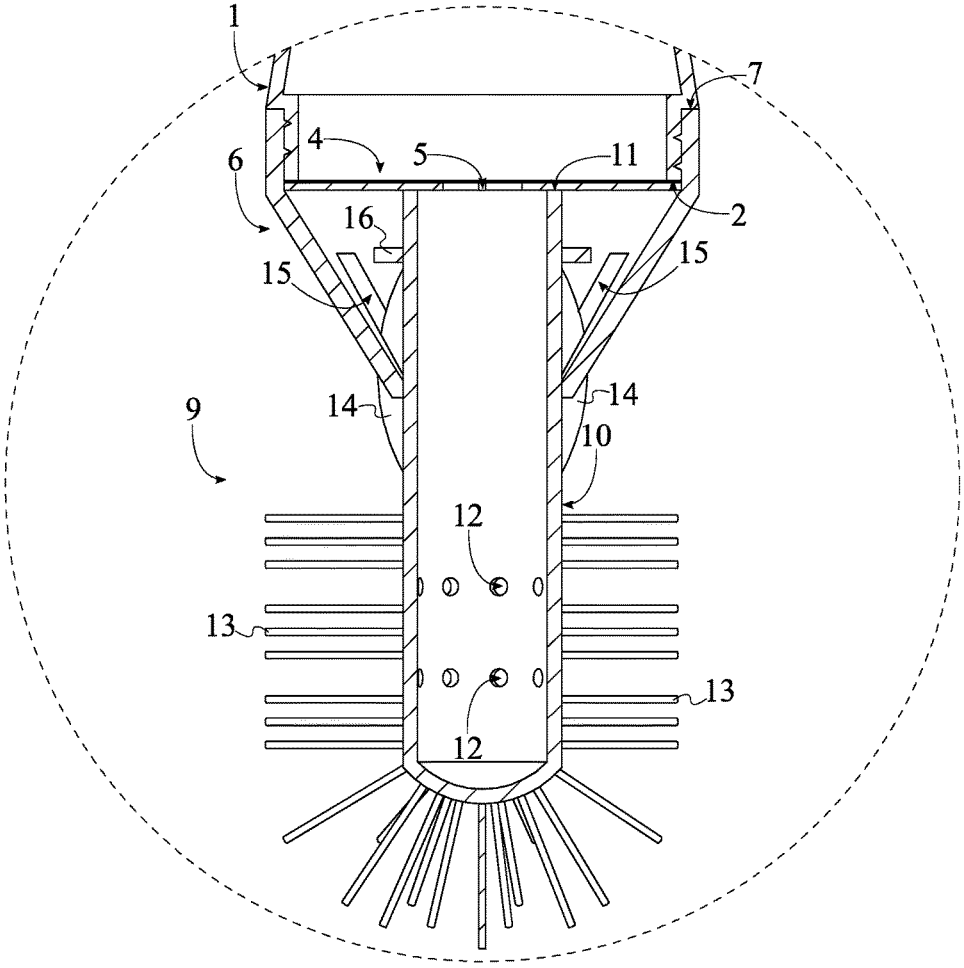
FIG. 6 is a detail view of the present invention taken along circle C of FIG. 5.

The cleaning implement 9 is utilized to clean objects such as toilet bowls as well as surfaces. The cleaning implement 9 is removably mounted into the cap 6, enabling the cleaning implement 9 to be removed and replaced to increase the versatility of the present invention. The cleaning implement 9 is slidably engaged through the cap 6 and is positioned adjacent to the expandable slot 5 as shown in FIG. 5 and FIG. 6. The cleaning implement 9 may thus be pressed against a surface, sliding the cleaning implement 9 through the cap 6 and pressing the cleaning implement 9 against the one-way valve plate 4. When the cleaning implement 9 is pressed against the expandable slot 5, the expandable slot 5 is opened, allowing cleaning fluid from within the elongated hollow handle 1 to exit through the expandable slot 5. The cleaning implement 9 is in fluid communication with the elongated hollow handle 1 through the expandable slot 5. As a result, cleaning fluid is able exit from the elongated hollow handle 1 through the expandable slot 5 and saturate the cleaning implement 9.

With continued reference to FIG. 5 and FIG. 6, in the preferred embodiment of the present invention, the cleaning implement 9 comprises a hollow dispensing member 10, a plurality of dispensing holes 12, and a plurality of bristles 13. The hollow dispensing member 10 serves as the body of the cleaning implement 9 on which the plurality of dispensing holes 12 and the plurality of bristles 13 are located. The hollow dispensing member 10 is slidably engaged through the cap 6, allowing the hollow dispensing member 10 to slide through the cap 6 when the cleaning implement 9 is pressed against a surface. Cleaning fluid from the elongated hollow handle 1 is able to pass through the hollow dispensing member 10 and exit through the plurality of dispensing holes 12 in order to saturate the plurality of bristles 13. The hollow dispensing member 10 is in fluid communication with the elongated hollow handle 1 through the expandable slot 5. As a result, when the expandable slot 5 is opened, cleaning fluid exits from the elongated hollow handle 1 into the hollow dispensing member 10. The hollow dispensing member 10 comprises a fluid input end 11 through which cleaning fluid from the elongated hollow handle 1 enters the hollow dispensing member 10. The fluid input end 11 is positioned adjacent to the expandable slot 5, allowing the fluid input end 11 to be pressed against the expandable slot 5 when the cleaning input end is pressed against a surface.

Figure 3:
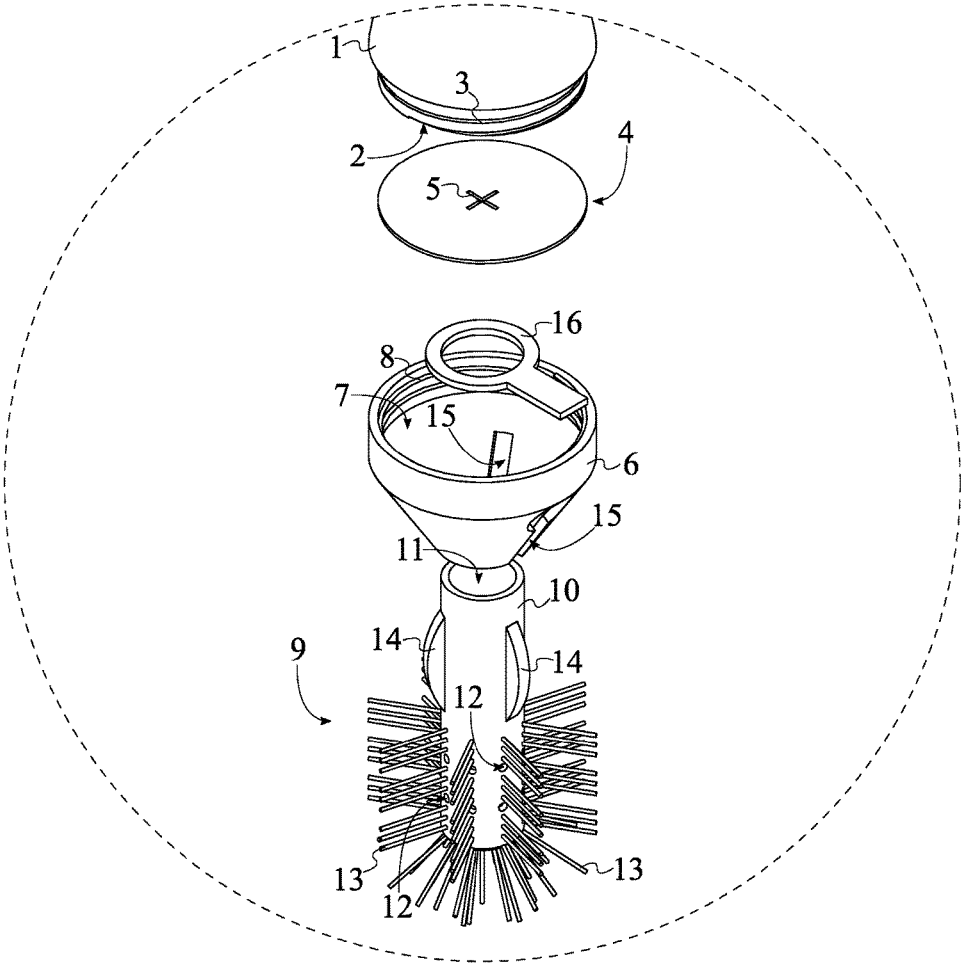
FIG. 3 is a detail view of the present invention taken from circle A of FIG. 2.
Figure 4:
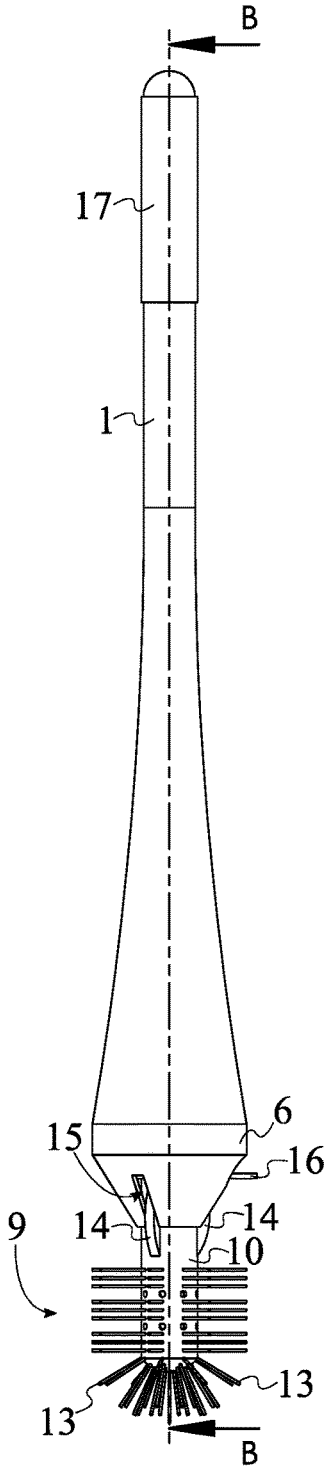
FIG. 4 is a front view of the present invention.

The plurality of dispensing holes 12 laterally traverses into the hollow dispensing member 10, allowing cleaning fluid to exit from within the hollow dispensing member 10 through the plurality of dispensing holes 12. As shown in FIG. 1, FIG. 3, and FIG. 6, the plurality of bristles 13 is laterally distributed about the hollow dispensing member 10, adjacent to the plurality of dispensing holes 12. Cleaning fluid exiting through the plurality of dispensing holes 12 is thus able to saturate the plurality of bristles 13.

The present invention further comprises a plurality of elongated slots 15 while the cleaning implement 9 further comprises a plurality of retaining fins 14. The plurality of elongated slots 15 and the plurality of retaining fins 14 are utilized to aid in retention of the cleaning implement 9 within the cap 6. The plurality of elongated slots 15 is radially positioned about the cap 6 while the plurality of retaining fins 14 is radially positioned about the hollow dispensing member 10. As a result, the plurality of elongated slots 15 may be aligned with the plurality of retaining fins 14 in order to aid in holding the cleaning implement 9 in place. The plurality of elongated slots 15 traverses into the cap 6, forming openings that are able to accommodate the plurality of retaining fins 14. A particular fin from the plurality of retaining fins 14 is engaged into a corresponding slot from the plurality of elongated slots 15. As a result, the cleaning implement 9 may be easily retained within the cap 6 while the present invention is in use.

Figure 7:
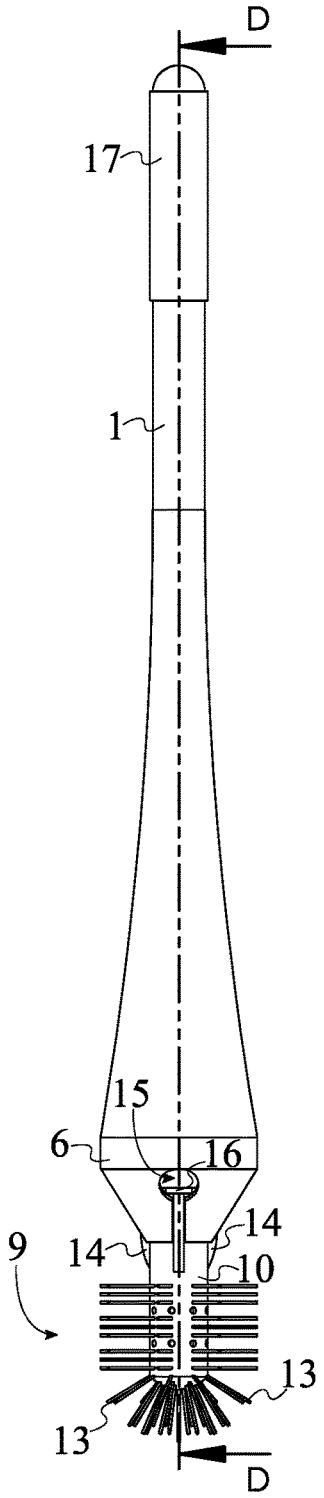
FIG. 7 is a side view of the present invention.
Figure 8:
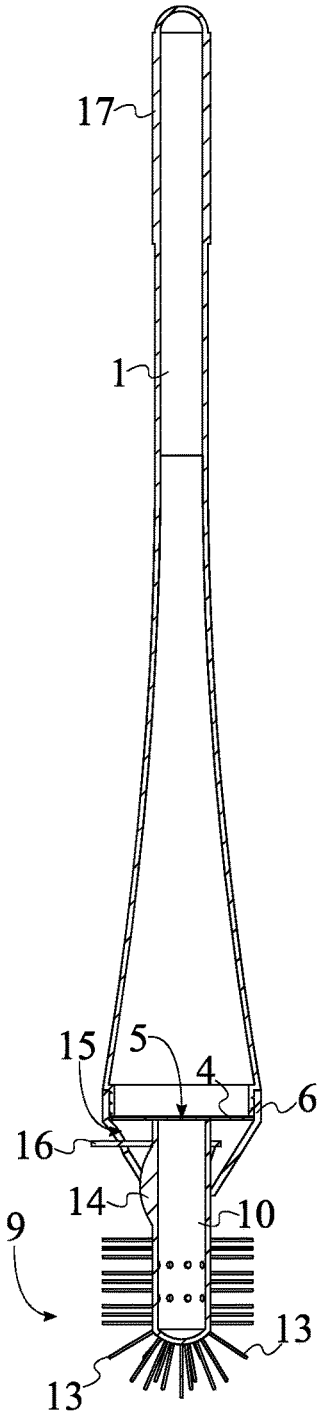
FIG. 8 is a cross-sectional view of the present invention taken along line D-D of FIG. 7.

The present invention further comprises a release lever 16. The release lever 16 is utilized to separate the cleaning implement 9 from the cap 6. As shown in FIG. 7, the release lever 16 is engaged through a particular slot from the plurality of elongated slots 15, allowing the release lever 16 to be actuated within the particular slot in order to separate the cleaning implement 9 from the cap 6. The release lever 16 is positioned around the cleaning implement 9, enabling the release lever 16 to hold the cleaning implement 9 in place within the cap 6 as shown in FIG. 8.

With reference to FIG. 3, the elongated hollow handle 1 further comprises a first threading 3 while the cap 6 comprises an open fastening end 7 and a second threading 8. The first threading 3 and the second threading 8 are utilized to secure the cap 6 to the elongated hollow handle 1. The open fastening end 7 is the portion of the cap 6 that is attached to the elongated hollow handle 1 and is removably engaged to the open end 2, allowing the cap 6 to be separated from the elongated hollow handle 1. The first threading 3 is helically positioned about the open end 2 while the second threading 8 is helically positioned within the open fastening end 7. The first threading 3 and the second threading 8 may thus be utilized to secure the open fastening end 7 of the cap 6 to the open end 2 of the elongated hollow handle 1. In the preferred embodiment of the present invention, the second threading 8 is removably engaged to the first threading 3, allowing the cap 6 to be secured to the elongated hollow handle 1 while also allowing the cap 6 to be easily separated from the elongated hollow handle 1.

Figure 2:
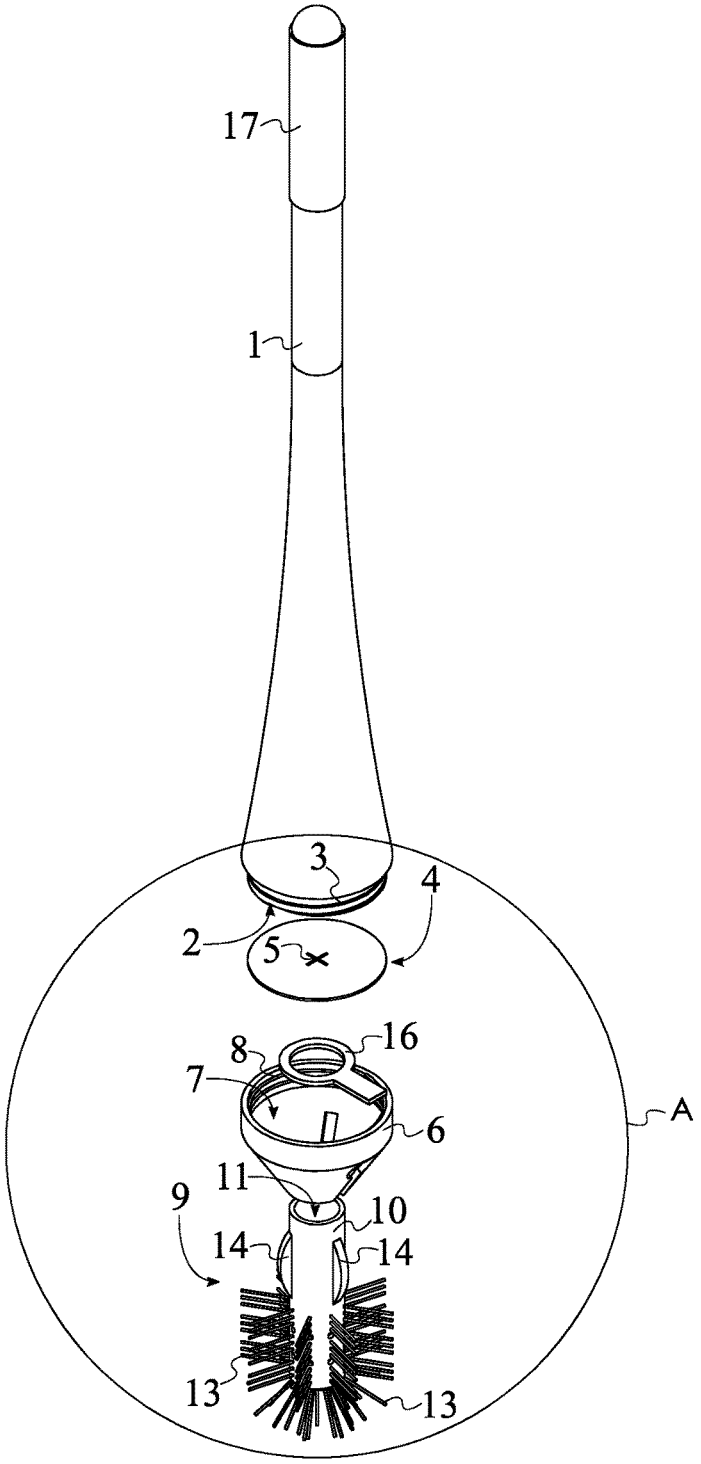
FIG. 2 is an exploded perspective view of the present invention.

With reference to FIG. 1 and FIG. 2, the present invention further comprises an annular grip 17. The annular grip 17 is utilized to facilitate the user's leverage on the present invention when the present invention is in use. The annular grip 17 is connected around the elongated hollow handle 1, opposite to the open end 2. As such, the annular grip 17 is able to improve the user's leverage and grip on the elongated hollow handle 1 while the present invention is in use.

Although the present invention has been explained in relation to its preferred embodiment, it is understood that many other possible modifications and variations can be made without departing from the spirit and scope of the present invention as hereinafter claimed.

What is claimed is:

1. A cleaning device with fluid dispenser comprises:
- an elongated hollow handle;
- a one-way valve plate;
- a cap;
- a cleaning implement;
- the elongated hollow handle comprises an open end;
- the one-way valve plate comprises an expandable slot;
- the one-way valve plate being hermetically positioned within the open end;
- the cap being removably and hermetically engaged to the open end;
- the cap being positioned around the open end;
- the cleaning implement being removably mounted into the cap;
- the cleaning implement being slidably engaged through the cap;
- the cleaning implement being positioned adjacent to the expandable slot, wherein the expandable slot is opened if the cleaning implement is pressed against the expandable slot; and
- the cleaning implement being in fluid communication with the elongated hollow handle through the expandable slot.

2. The cleaning device with fluid dispenser as claimed in claim 1 further comprises:
- the cleaning implement comprises a hollow dispensing member, a plurality of dispensing holes, and a plurality of bristles;
- the hollow dispensing member being in fluid communication with the elongated hollow handle through the expandable slot;
- the plurality of dispensing holes laterally traversing into the hollow dispensing member; and
- the plurality of bristles being laterally distributed about the hollow dispensing member, adjacent to the plurality of dispensing holes.

3. The cleaning device with fluid dispenser as claimed in claim 2 further comprises:
- the hollow dispensing member being slidably engaged through the cap.

4. The cleaning device with fluid dispenser as claimed in claim 2 further comprises:
- the one-way valve plate being positioned within the cap.

5. The cleaning device with fluid dispenser as claimed in claim 2 further comprises:
- the hollow dispensing member comprises a fluid input end; and
- the fluid input end being positioned adjacent to the expandable slot.

6. The cleaning device with fluid dispenser as claimed in claim 1 further comprises:
- a plurality of elongated slots;
- the cleaning implement comprises a hollow dispensing member and a plurality of retaining fins;

the plurality of elongated slots being radially positioned about the cap;

the plurality of elongated slots traversing into the cap;

the plurality of retaining fins being radially positioned about the hollow dispensing member; and a particular fin from the plurality of retaining fins being engaged into a corresponding slot from the plurality of elongated slots.

7. The cleaning device with fluid dispenser as claimed in claim 1 further comprises:

a release lever;

a plurality of elongated slots;

the plurality of elongated slots traversing into the cap;

the release lever being engaged through a particular slot from the plurality of elongated slots; and the release lever being positioned around the cleaning implement.

8. The cleaning device with fluid dispenser as claimed in claim 1 further comprises:

the elongated hollow handle further comprises a first threading; and the first threading being helically positioned about the open end.

9. The cleaning device with fluid dispenser as claimed in claim 1 further comprises:

the cap comprises an open fastening end and a second threading;

the open fastening end being removably engaged to the open end; and the second threading being helically positioned within the open fastening end.

10. The cleaning device with fluid dispenser as claimed in claim 1 further comprises:

a second threading of the cap being removably engaged to a first threading of the elongated hollow handle.

11. The cleaning device with fluid dispenser as claimed in claim 1 further comprises:

an annular grip; and the annular grip being connected around the elongated hollow handle, opposite to the open end.

* * * * *